United States Patent [19]

Elliott

[11] 4,445,617

[45] May 1, 1984

[54] STRIKER FOR A RAILWAY COUPLER

[75] Inventor: William O. Elliott, Pittsburgh, Pa.

[73] Assignee: McConway & Torley Corporation, Pittsburgh, Pa.

[21] Appl. No.: 410,080

[22] Filed: Aug. 25, 1982

Related U.S. Application Data

[63] Continuation-in-part of Ser. No. 302,772, Sep. 16, 1982, abandoned.

[51] Int. Cl.[3] ..... B61G 9/20

[52] U.S. Cl. ..... 213/60; 105/420; 213/50; 213/58

[58] Field of Search ..... 213/50, 58, 59, 60; 105/420, 421

[56] References Cited

U.S. PATENT DOCUMENTS

| | | | |
|---|---|---|---|
| 1,877,335 | 9/1932 | Lounsbury | 213/50 |
| 2,258,208 | 10/1941 | Johnson | 213/57 |
| 2,262,076 | 11/1941 | Wolfe | 213/58 X |
| 2,638,233 | 5/1953 | Wolfe | 105/420 X |
| 2,706,051 | 4/1955 | Nystrom | 213/58 X |
| 2,743,822 | 5/1956 | Kayler | 213/60 |

*Primary Examiner*—Randolph Reese

*Attorney, Agent, or Firm*—Thomas H. Murray; Clifford A. Poff

[57] ABSTRACT

A striker for a railway vehicle comprises a casting having an endless rib projecting outwardly from each side wall to reinforce a key slot for a draft key. The endless ribs present continuous surfaces for welding the striker to a sill of a railway vehicle. Above and below the endless rib on each side wall are inwardly-displaced side wall sections to inwardly shift the neutral axes of the wall sections for resisting imposed loads. In a second embodiment, weld sites above and below the endless ribs are formed. High-strength load transfer for pull forces is achieved at weld sites at the rear portion of the casting. Load transfer is supplemented by lower-strength weld sites at the forward portion of the casting. Other weld sites are formed along vertical parts of front draft lugs.

14 Claims, 9 Drawing Figures

STRIKER FOR A RAILWAY COUPLER

CROSS-REFERENCE TO RELATED APPLICATION

This application is a continuation-in-part of application Ser. No. 302,772, filed Sept. 16, 1982, now abandoned.

BACKGROUND OF THE INVENTION

This invention relates to a striker embodying an improved construction and relationship of parts for attachment to the sill of a railway vehicle and for more efficiently transferring pull and buff forces between a coupler and a railway vehicle. More particularly, the present invention relates to such a striker having an endless rib projecting outwardly from each side wall to reinforce a key slot in the side wall and present a continuous surface for welding the striker to the sill of a railway vehicle. The present invention also provides a striker having inwardly-displaced side wall sections above and below key-slot openings in the side walls to: (a) inwardly shift the neutral axes of the wall sections for loads imposed on front draft lugs of the striker: and preferably (b) form welding sites at high-strength wall sections for a major transfer of loads on the striker.

Conventional striker castings for E-type couplers have a discontinuous rib protruding from the lateral side walls of the striker casting. The key-slot reinforcement rib has terminal end faces directed rearwardly of the casting and spaced from draft lugs which are flat surfaces orientated vertically when the striker is operatively arranged in the sill of a railway vehicle. The key-slot reinforcement ribs protrude from the side walls of the striker and form extensions to part of horizontal key-slot openings in the side walls which align with the key-slot opening in the shank of a railway coupler. A yoke engaged with the draft gear at the rear of the striker has a nose portion that extends forwardly along the side edges of the coupler shank within a pocket opening of the striker. The nose portion of the yoke has key slots to register with the key slots in the coupler shank and the side walls of the striker so that a key can be passed horizontally through all of the key slots. The key, usually identified as a draft key, is pulled forward by the coupler and seats against the forward ends of the key slots in the yoke and slides within the striker key slot in the pull-mode of operation. However, before the draft key slides along the striker key slot, the pull force on the coupler is transmitted by the key in its shank to the yoke which, in turn, imposes the pull load on a draft gear which is transmitted through follower blocks to the front draft lugs of the striker. The striker is welded to the sill of the railway vehicle to transmit the pull force to the railway vehicle.

Buff forces on the coupler first push the coupler shank rearwardly in the striker so that the butt end of the coupler shank seats against the draft gear. The initial buff forces compress the draft gear against the rear draft lugs. The rear lugs transmit the buff forces to the structure of the car underframe. As the draft gear compresses, the coupler key slot contacts and slides the draft key rearwardly along the striker key slot. The draft gear also serves to reduce tremendous load shocks and prevents rigorous pounding as the draft loads shift between the rear and striker draft lugs. The cyclic loading on the striker draft lugs by the draft gear in the past caused the welded connection between the striker and the sill to fail. The present invention is based on the discovery that the design of the striker casting contributed to weld failures because only a discontinuous weld bead could be formed. The striker design required termination of weld metal at the rear part of the striker where projecting key-slot ribs terminate.

Another deficiency of known strikers relates to draft lugs at the rear of the casting usually called "front draft lugs". The vertical side walls of known striker castings are planar, parallel wall sections having a right-angled, cantilevered web which forms the draft lugs. Usually, inwardly-projecting ribs are formed on the rear inside part of the side wall, but they fail to sufficiently strengthen the walls against an inward bowing due to forces acting on the draft lugs during operation of the coupler. This imposes an undue stress on the striker casting at the rear portion closely adjacent the draft lugs. Such stress must be resisted by the weld metal that is discontinuous at this area to maintain the integrity of the attachment with the sill of the railway vehicle. At the terminal end portions of the weld beads, the weld metal tears away from the striker casting and/or sill, allowing side walls of the striker casting greater freedom to flex and ultimately a complete fatigue or brittle fracture weld failure.

SUMMARY OF THE INVENTION

It is an object of the present invention to provide a striker having an improved design to alleviate the problems associated with known designs of strikers discussed hereinabove.

It is a further object of the present invention to provide an improved striker for attachment to a sill of a railway vehicle by an endless bead of weld metal on an essentially endless rib surrounding a key slot in each of the side walls of the striker.

It is a still further object of the present invention to provide a striker for attachment to a sill of a railway vehicle in which the side wall sections project inwardly into a pocket opening within the striker at the rear of the side walls having draft lugs on end portions thereof and such inwardly-projecting side wall sections are constructed to form, if desired, high-strength welding sites for attaching the striker to the sill.

It is another object of the present invention to provide a striker having side wall sections with increased thickness to form high-strength welding sites symmetrically situated above and below aligned key slots in the side walls of the striker together with additional weld sites that are also symmetrically situated above and below the key slots and spaced from the high-strength welding sites for attaching the striker to a sill of a railway car More particularly, according to the present invention there is provided a striker for attachment to the sill of a railway vehicle to transmit forces from a draft key engaged with the shank of a coupler, the striker comprising top, bottom and side walls projecting from a front striker face defining a pocket opening for receiving the shank portion of a coupler, the bottom wall extending between forward lower parts of the side walls for supporting the shank portion of the coupler while extending into the pocket opening, the side walls having aligned horizontal key slots to receive portions of the draft key, front draft lugs on end portions of the side walls facing opposite the striker face for arrangement in a force-transmitting relation with a coupler draft gear, and endless ribs each essentially surrounding one of the key slots and projecting outwardly from the side walls for attachment to the sill of a railway vehicle.

In yet another aspect of the present invention, the striker is characterized by side wall sections projecting inwardly into a pocket opening formed between the side walls. The side wall sections project above ahd below rib sections on each side wall to inwardly shift the neutral axis of the wall section under an imposed load. These side wall sections preferably have an increased thickness as compared with adjacent wall sections and form high-strength welding sites for transferring a major part of the forces to the sill of the railway vehicle. Other welding sites are established above and below the ribs of the key slots forwardly toward the striker face of the striker.

These features and advantages of the present invention as well as others will be more fully understood when the following description is read in light of the accompanying drawings, in which.

Figure 1:
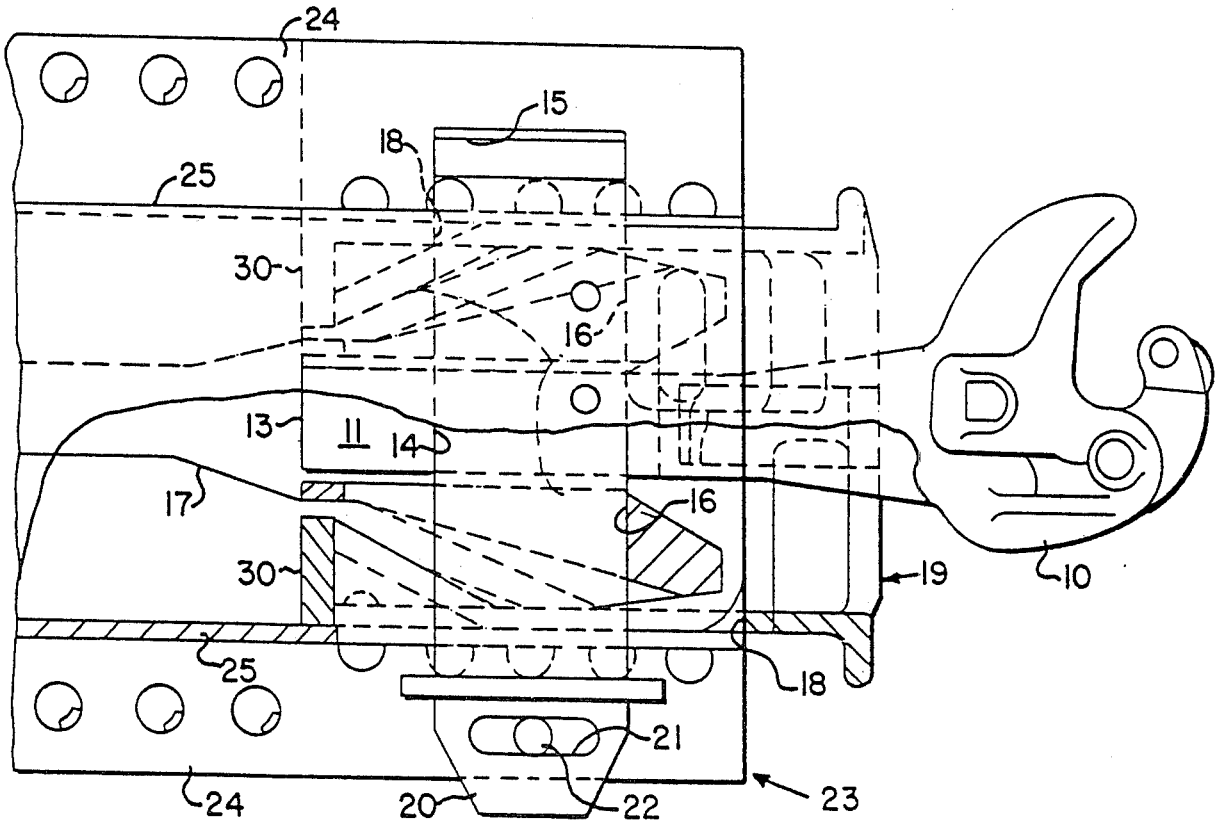
FIG. 1 is an elevational view, partly in section, of an E-coupler arrangement including the striker of the present invention.
Figure 2:
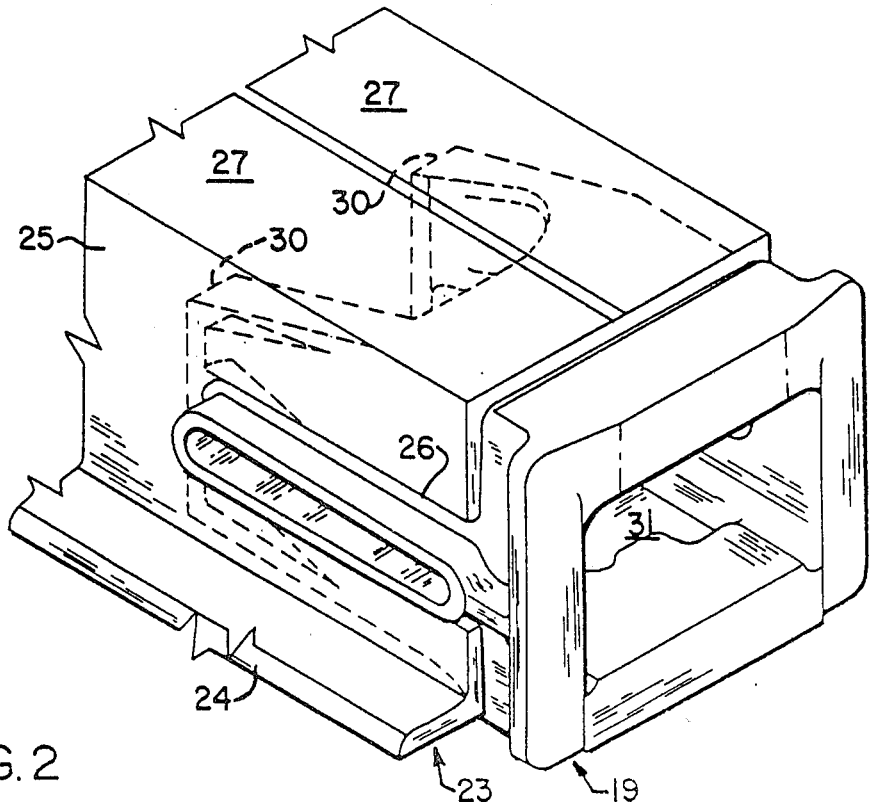
FIG. 2 is an isometric view of a Z-sill for a railway vehicle together with the striker of the present invention.

In FIG. 1 of the drawings, a standard railroad E-type coupler assembly is shown that includes a coupler 10 constructed in a manner, per se, well known in the art. Extending rearwardly of the coupler head is a coupler shank 11 having a butt end 13 and a horizontal key slot 14 in the rear portion thereof. A draft key 15 extends through the key slot and projects from opposite sides of the coupler shank outwardly through openings 16 in the nose portion of a yoke 17. As will be described in greater detail hereinafter, the draft key extends through a key-slot opening 18 in a striker casting 19. One end of the draft key is provided with a retainer 20 having an elongated slot 21 that receives a retainer pin 22 extending upwardly from part of a sill 23. The sill 23 may take the form of any well-known sill configuration. The sill shown in FIGS. 1 and 2 is a Z-sill made up of two Z-shaped sections having flange portions 24. The sill is attached to part of the fabricated construction of the underframe of the car. Upstanding side sill portions 25 each includes a horizontal slot 26. The side portions 25 are joined with top portions 27. The top portions 27 are welded together along their longitudinal edges so that a pocket is formed for receiving the striker casting 19. It can be seen from FIG. 1, that the draft key 20 projects from opposite sides of the upstanding portions 25 of the Z-sill.

To lessen the impact forces between the pull-mode and buff-mode of operations, the usual draft gear is arranged in a draft gear pocket formed in the coupler yoke 17. One end of the draft gear is seated against a draft gear face at the rear part of the yoke as well as the car construction rear draft lugs while the opposite end of the draft gear engages follower blocks that are interposed between the draft gear and front draft lugs 30 of the striker casting 19. In the pull-mode of operation, the coupler shank may move a slight distance within a pocket 31 formed in the striker casting to eliminate clearances between the draft key and the key slot in the coupler shank. A cushioning of the pull force occurs by compression of the draft gear as the draft key seats against the forward key surface in the nose portion of the yoke. Further cushioning occurs as the draft key moves toward the forward portions of elongated slots in the striker casting. In the buff-mode of operation, the coupler shank moves into the striker casting against the draft gear until clearances are eliminated between the key and the key-slot opening in the coupler shank as well as between the key and the key-slot openings in the nose portion of the yoke. It is to be understood that in FIG. 1, the coupler shank will move to take up clearances in the direction of the right side of the illustration in the pull-mode of operation. In the buff-mode of operation, the coupler shank will move toward the left side of the illustration. In the buff mode, the butt end 13 of the coupler shank will come to rest on part of the draft gear which undergoes a yielding-type compressive movement to soften the impact load requiring the key to slide rearwardly in the key slots 32 in the striker casting.

Figure 3:
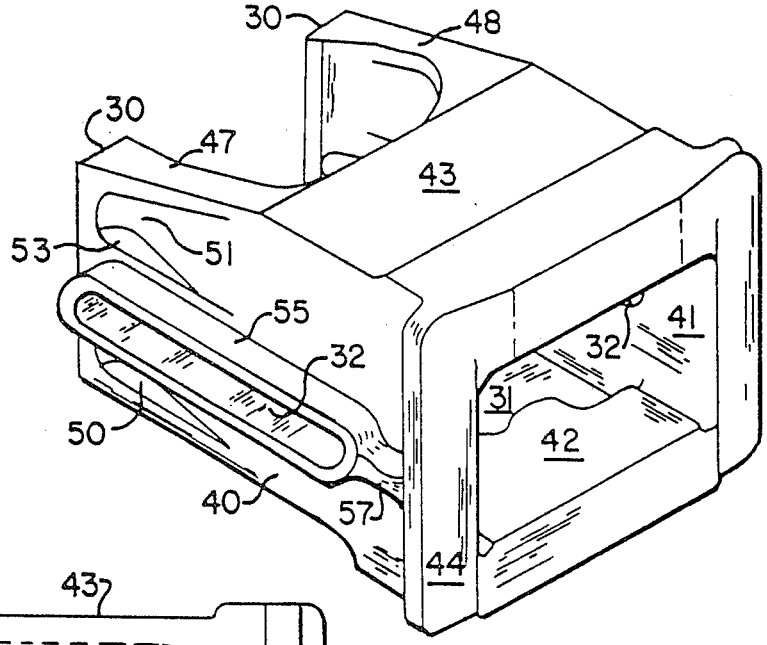
FIG. 3 is an isometric view of the striker according to one embodiment of the present invention.
Figure 4:
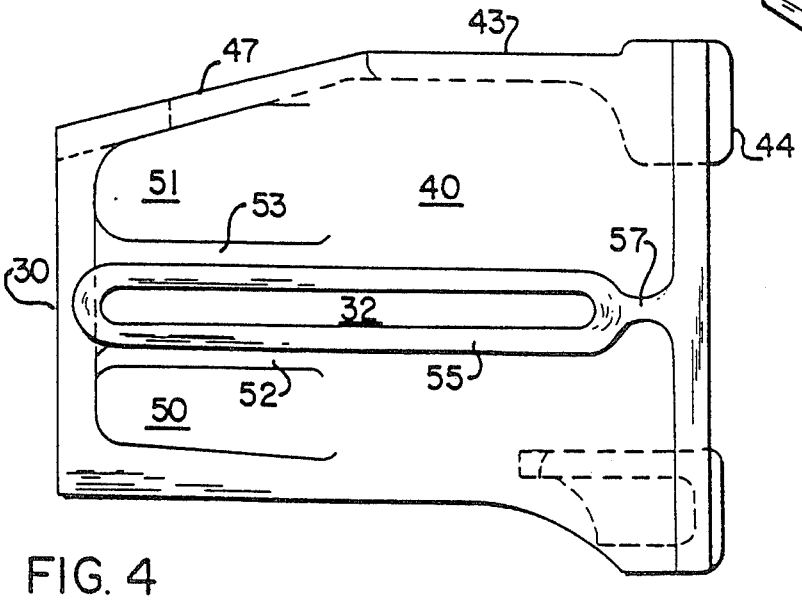
FIG. 4 is a side elevational view of the striker shown in FIG. 3.
Figure 5:
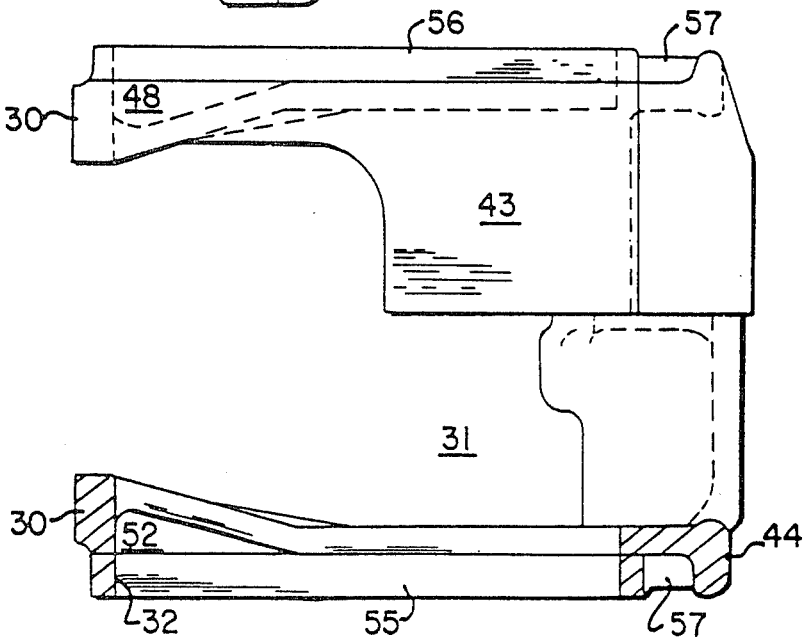
FIG. 5 is a plan view, partly in section, of the striker shown in FIGS. 3 and 4.
Figure 6:
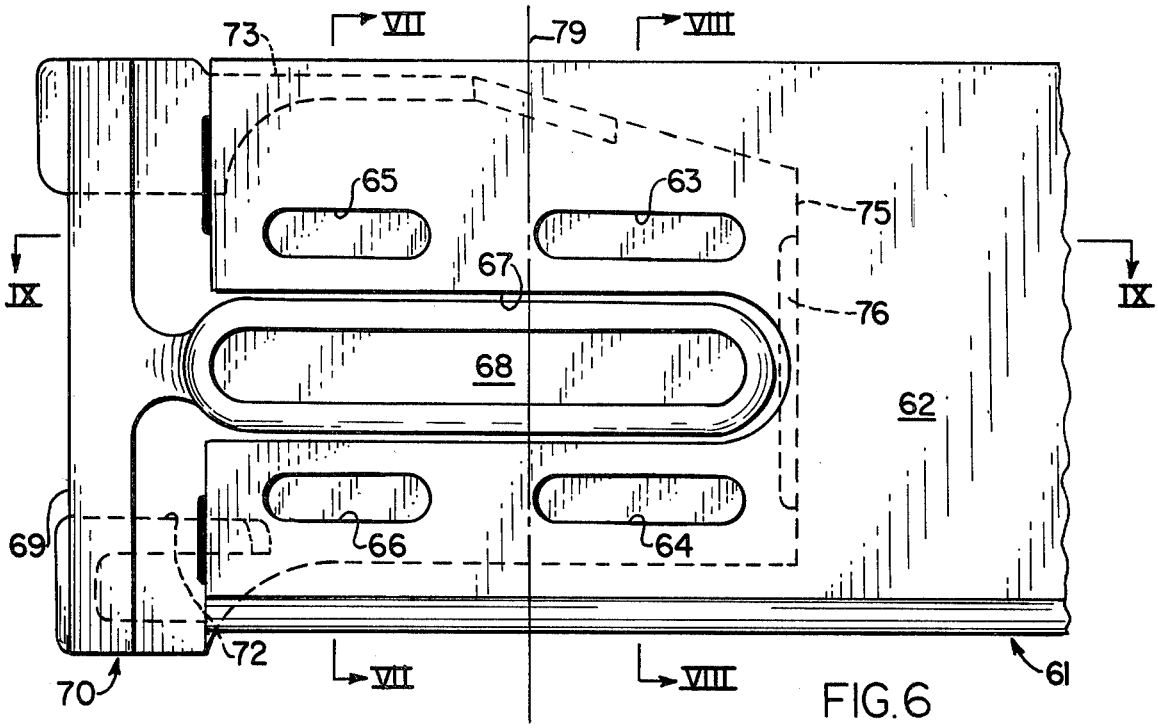
FIG. 6 is a side elevational view of a further embodiment of a striker shown within a Z-sill.
Figure 8:
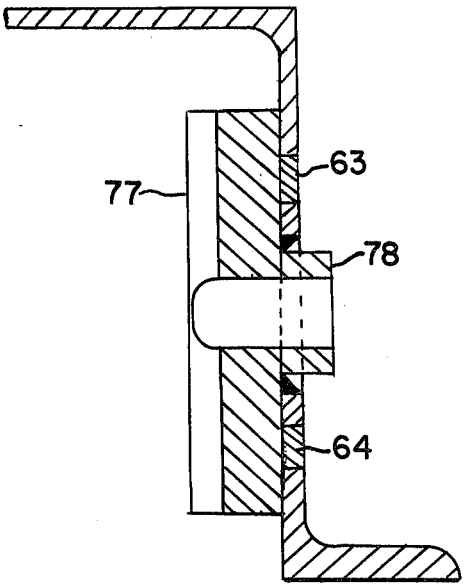
FIG. 8 is a partial sectional view taken along line VIII—VIII of FIG. 6.
Figure 7:
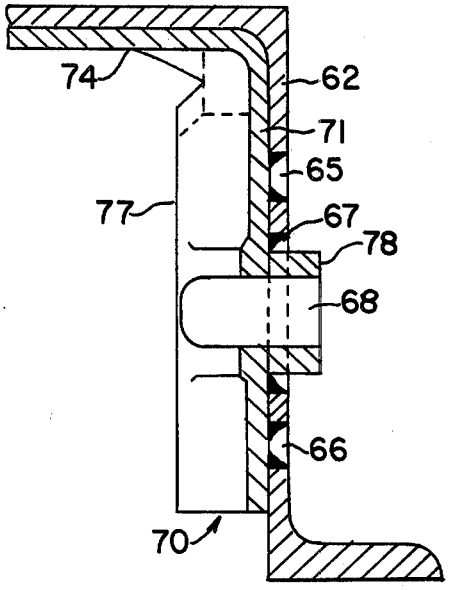
FIG. 7 is a partial sectional view taken along line VII—VII of FIG. 6.

Turning, now, more specifically to one embodiment of the striker casting according to the present invention. As shown in FIGS. 3–5, the casting includes spaced-apart side walls 40 and 41 joined together along their forward bottom portion by a bottom wall 42 which has a face surface extending between the side walls 40 and 41 commonly referred to as a coupler carrier that receives a carrier wear plate, not shown. The carrier wear plate can be of the type well known, per se, in the art. Overlying the bottom wall 42 and joining the side walls 40 and 41 at their forward top portions is a top wall 43. Walls 40–43 extend forwardly of the casting to define a striker face 44. The striker face has side flanges that project outwardly from the side walls 40 and 41. The area surrounded by the walls 40–43 forms the pocket opening 31 into which the shank portion of a coupler is received in the manner described hereinbefore. The side walls 40 and 42 extend rearwardly from the striker face to vertical face surfaces which define the front draft lugs 30. The draft lugs are joined by top wall sections 47 and 48 to the top wall 43 in a manner to form an opening in the top wall. The lower ends of the front draft lugs intersect with the planar edges of the side walls 40 and 41. The front draft lugs have relatively broad faces that engage with the follower blocks for the draft gear.

The neutral axes of the side walls 40 and 41 which define the load-bearing capacity for the draft lugs and rear portions of the side walls are shifted inwardly toward the pocket 31 such that each axis does not lie midway between the vertical sides of the side walls. Shifting the neutral axis inwardly brings about a repositioning of these axes closer to the load line, thereby reducing bending stresses on the side walls. The present invention provides that shifting of the neutral axis is carried out in this embodiment by providing inwardly-extending or depressed side wall sections 50 and 51 in each of the side walls 40 and 41 above and below the key-slot opening 32. As clearly apparent from FIGS.

3–5, the depressed side wall sections 50 and 51 commence at a plane slightly spaced rearwardly from the center portion of the key slot. The depressed wall sections taper in a manner to protrude into the pocket opening so that at the rear of the wall sections, they form a flush relation with vertical edges defining the inner edges of the front draft lugs within the pocket 31. The load-receiving face of the front draft lugs is preferably about 2-1/16 inches wide, whereby the internal surface of the depressed wall sections 50 and 51 is displaced by this same distance to form a flush relation with the inner edges of the draft lugs. Above and below each depressed wall section 50 and 51 is a rib section 52 and 53, respectively. The rib sections extend to the planar characteristic of the side walls 40 and 41 at the outside surface of the casting.

The striker casting further includes endless ribs 55 and 56 protruding outwardly from the side walls 40 and 41, respectively. The endless ribs surround slots 32 which are formed in the side walls 40 and 41. The forward portions of the endless ribs 55 and 56 are joined by short web sections 57 to the rear face of the flanges forming the front striker face 44. Each endless rib at the rear of the striker casting is essentially continuous and defines a reverse bend by arcuate end sections to longitudinal side sections of the rib that extend along the edge portions of the key slot. As best shown in FIG. 2, the ribs 55 have a projected width, e.g., about 1⅜ inches, from the side walls so that they extend through the slot which is formed in the Z-sill. A bead of weld metal can be used to join the striker casting to the Z-sill by a deposit thereof running continuously about the entire slot in the Z-sill. It is particularly important that the bead of weld metal runs continuously about the rear portion of the ribs 55 and 56. This eliminates a source of weld failures discovered from past striker designs. In the past, terminal ends of weld beads were created closely adjacent the front draft lugs where a transmission of large forces occurred including bending forces on the side walls of the striker.

By providing depressed wall sections 50 and 51 in the side walls of the draft lugs of the striker casting, the present invention provides a geometrically stronger casting capable of effectively resisting the bending stresses. The striker casting can be installed in a more efficient manner since a pattern used to form the slots in the Z-sill can be split on the car length center line enabling the maintenance of the key slot protruding through the Z-sill. The ribs 55 and 56 encircle the draft key at each side wall allowing for greatly improved welding conditions when the striker casting is to be welded to the sill. A foundry pattern for use in the metal casting process to produce the striker casting can be simplified since it can be designed to require the use of only two split cores and greater tolerances can be maintained. The outside walls of the striker casting can be fitted with closer tolerances to the inside walls of the Z-sill since a draft on the side walls can be eliminated.

Turning, now, to FIGS. 6–9, there is illustrated a further embodiment of the striker casting that essentially provides weld sites above and below the key-slot opening in the casting as well as vertical weld sites along the end portion of front draft lugs. The description of the striker casting and the Z-sill given hereinbefore apply substantially with equal effect to this embodiment of the invention.

In FIGS. 6–9, the Z-sill is essentially the same as Z-sill 23 except that upstanding side portions 62 have four horizontally-extending weld slots 63, 64, 65 and 66. Slots 63 and 64 are elongated in the longitudinal direction of the sill and arranged symmetrically with respect to key-slot opening 67 to define welding sites above and below the key-slot opening 68. In a similar manner, weld slots 65 and 66 extend in the horizontal direction of the sill at the forward part of the key-slot openings 68, i.e., at sites that are spaced forwardly toward the striker face 69 of the striker casting 70 with respect to weld slots 63 and 64. The weld slots 65 and 66 have an area which is about 80% of the area defined by weld slots 63 and 64, respectively. The striker casting 70 includes spaced-apart side wall sections 71, only one shown, joined together in the same manner as previously described along their forward bottom section 72 forming a coupler carrier for a carrier wear plate. A top wall section 73 joins the side wall sections 71 at their forward top portion. The wall sections 71–73 extend forwardly of the casting to define the striker face 69 that includes side flanges projecting outwardly from the side wall sections 71. The area surrounded by wall sections 71–73 forms a pocket opening 74 into which the shank portion of a coupler is received. Each side wall section 71 extends rearwardly from the striker face 69 to a vertical face surface that defines a front draft lug 75. The draft lugs are joined in the same manner as previously described by top wall sections 73 to form an opening in the top wall. The lower ends of the draft lugs intersect with planar edges of the side wall sections 71. The front draft lugs have relatively broad faces to engage with the follower blocks of the draft gear. A vertically-extending weld slot 76, preferably constructed as a J-groove, extends along the outer edge portions of each lug face. In its preferred form, the present invention provides that the J-grooves extend along a major part of the height of the front draft lugs. The J-grooves may terminate short distances from the top and bottom of the draft lugs.

Figure 9:
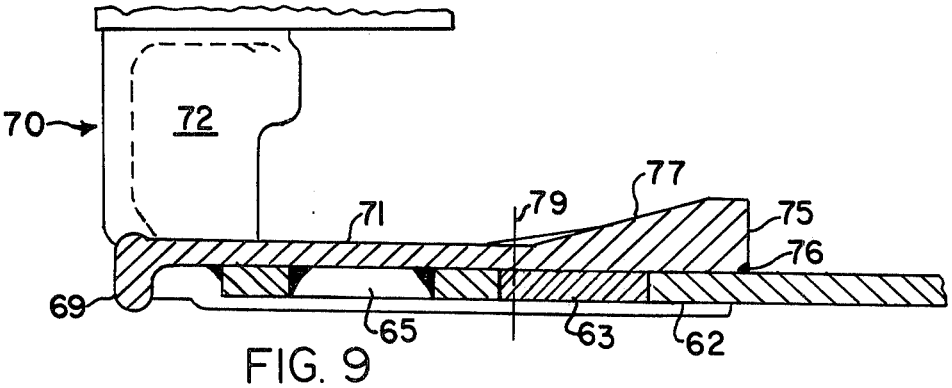
FIG. 9 is a partial sectional view taken along line IX—IX of FIG. 6.

The load-bearing capacity for the draft lugs and the rear portions of the side walls is increased by shifting of the neutral axis of the side wall portions 71 in substantially the same manner as described hereinbefore. The shifting of the neutral axis is carried out in this embodiment of the present invention by providing inwardly-extending wall sections 77 that are solid in a horizontal cross section as shown in FIG. 9. The outside surfaces of wall sections 71 and 77 are substantially coplanar; whereas the inside surface of each wall section 77 is planar but angular and extends from the inner toe part of the draft lug in a sloping manner to the inner face of wall section 71. Wall section 77 extends substantially the height of the wall 71 at the rear portion of the casting as shown so as to define high-strength wall sections exposed by the weld slots 63 and 64. The high-strength wall sections form weld sites capable of a major transfer of loads, especially pull forces, between the striker casting and the sill at the rear portion of the striker casting. The majority of the pull force is transferred through this high-load transfer section. Forwardly of the section, there is a lower load-transfer section formed by wall sections of the striker which are exposed by weld slots 65 and 66 at each side of the striker casting.

The weld sites formed by slots 63–66 are aligned horizontally and similarly spaced above and below the key slot. Because of this slot arrangement, weld slots 65 and 66 do not impede transfer of a major part of the load through high-load transfer section. The lower load-transfer section at the forward end of the striker contributes to the transfer of a pull force in a supplementary manner rather than in an alternative manner. However, the transfer of forces through the lower load-transfer area is a major load transfer site for vertical loading forces on the coupler which are transferred to the sill. Moreover, weld sites at the lower load-transfer area are sufficient to hold the forward portion of the striker casting in place and prevents loading by long moment arms on the weld sites at the high-load transfer section. The high and lower load-transfer sections augment the transfer of loads by the endless bead of weld metal about the essentially endless rib 78 which surrounds the key-slot opening 68 in the striker casting and the load-transfer welding site at the front draft lugs.

Current AAR requirements provide that load transfer between a striker and a sill must withstand a draft load of 350,000 pounds with a safety factor of 1.8 or 630,000 pounds with stresses limited to the yield point of the material. The striker of this embodiment of the present invention can withstand draft loads of 500,000 pounds with a 1.8 safety factor or 900,000 pounds without reaching the yield point of the material. It is undesirable to maintain welding sites used in the past. For example, one notorious welding site in the past was along the bottom edge of the striker side walls at the lower inner portion of the sill. Weld in this area has been discovered to fail first because it is situated to transfer a large portion of bending loads. Moreover, weld in this area is non-symmetrical which creates a third plane bending moment in the form of a torsion about symmetrical weld center lines. Such a third plane bending moment is unnecessary and eliminated according to the present invention.

Casting techniques to produce the striker of the present invention can be carried out to eliminate draft to the mold surfaces from the front to the back of the ultimate striker casting. Two split cores can be used with an additional core at the top of the cavity to form the Z-sill mating surface and thereby eliminate draft to mold surfaces and provide desired flatness to the casting walls.

The construction of the striker casting together with a designation of weld sites for attachment of the casting to the Z-sill provides a more efficient and superior shear load transfer at the weld sites as compared with the prior casting designs and welding procedures. A major load on the striker which must be transferred to the sill is applied to the striker on the front draft lugs thereof from the draft gear. According to the present invention, the majority, i.e., at least 65% to 85% of the load on the front draft lugs is transferred through the shear area of the weld at welding sites 63 and 64 as well as through welding sites at grooves 76 and by weld about the rear part of rib section 78. Preferably, about 80% of the load imposed on the rear draft lugs is transferred before a transition occurs to relatively thinned-wall portions at the forward part of the casting. It is important to the successful load transfer process that only a minor part, preferably 20% of the weld shear area is applied at the forward part of the casting. Thus, only a small minor part of the force on the front draft lugs is transferred forwardly of the casting beyond a transverse plane 79 at the termination of the wall sections 77. Forwardly of this plane, the wall sections are thinner but adequate to withstand the minor part of forces that must be transmitted. To insure that the thinner wall sections are not stressed beyond the yield point of the material, only fillet welds should be formed in the weld surfaces formed by slots 65 and 66. However, high shear strength plug welds should be formed in the slots 63 and 64 on wall sections 77 to withstand high shear loads.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A striker for attachment to a sill of a railway vehicle to transmit forces from a draft key engaged with the shank of a coupler, said striker comprising top, bottom and side walls projecting from a front striker face defining a pocket opening for receiving a shank portion of a coupler, said bottom wall extending between a forward lower part of said side walls for supporting the shank portion of the coupler while extending into said pocket opening, said side walls having aligned horizontal key slots to receive portions of said draft key, front draft lugs on end portions of said side walls facing opposite said striker face for arrangement in a force-transmitting relation with a coupler draft gear, rib sections projecting outwardly from said side walls for attachment to said sill of a railway vehicle, and side wall sections projecting inwardly into said pocket opening above and below the rib sections on each side wall to define recesses therein to inwardly shift the neutral axis of the wall section under an imposed load.

2. The striker according to claim 1 wherein said side wall sections extend to the inner edge of said front draft lugs, and other sections of said side walls extend to the outer edge of the front draft lugs.

3. The striker according to claim 1 further including web wall sections joining said side wall sections to said side walls.

4. The striker according to claim 1 wherein said side wall sections are solid with face surfaces externally of said pocket opening substantially coplanar with the adjacent surface of a side wall, and wherein said side wall sections have inwardly-tapering face surfaces in said pocket opening that are non-planar with adjacent face surfaces with the side walls.

5. A striker for attachment to a sill of a railway vehicle to transmit forces from a draft key engaged with the shank of a coupler, said striker comprising top, bottom and side walls projecting from a front striker face defining a pocket opening for receiving a shank portion of a coupler, said bottom wall extending between a forward lower part of said side walls for supporting the shank portion of the coupler while extending into said pocket opening, said side walls having aligned horizontal key slots to receive portions of said draft key, front draft lugs on end portions of said side walls facing opposite said striker face for arrangement in a force-transmitting relation with a coupler draft gear, rib sections projecting outwardly from said side walls for attachment to said sill of a railway vehicle, and side wall sections projecting inwardly into said pocket opening above and below the rib sections on each side wall to inwardly shift the neutral axis of the wall section under an imposed load, said side wall sections are solid each having an increased thickness as compared with immediately adjacent side wall sections to form high-strength welding sites.

6. The striker according to claim 5 wherein said side walls each further defines welding sites on a substantially uniform wall thickness symmetrically situated above and below said aligned key slots and spaced forwardly toward said front striker face from said solid side wall sections.

7. The striker according to claim 1, 5 or 10 wherein said front draft lugs define welding sites along the major vertical heights thereof for attachment to said sill.

8. The striker according to claim 6 wherein said welding sites on a substantially uniform wall thickness define an area of about 80% or less than the area defining said high-strength welding sites.

9. The striker according to claim 1, 5, 6 or 8 wherein said rib sections define continuous welding sites extending along opposite sides and at an end of each of said horizontal key slots for attachment to said sill.

10. Apparatus for attaching a striker to a sill for a railway vehicle to transmit forces from a draft gear to the sill, the combination including:

a striker having walls including spaced-apart side walls projecting from a front striker face to form a pocket opening for a shank portion of a coupler extending into said pocket opening, said striker having front draft lugs on end portions of said side walls facing opposite said striker face, rear portions of said side walls including thickened side wall sections extending to said rear draft lugs for forming high-strength welding sites, means for forming high-shear strength weld attachments between said sill and said high-strength weld sites, and means for forming substantially lower shear strength weld attachments as compared with said high-shear strength weld attachments between said sill and said side walls in an area between said front striker face and said high-shear strength weld attachments.

11. The apparatus according to claim 10 wherein said means forming high-shear strength weld attachments includes horizontally-elongated slots in said sill, and plug welds in said slots at said high-shear strength weld sites.

12. The apparatus according to claim 10 or 11 wherein said means forming substantially lower shear strength weld attachments includes horizontally-extending weld surfaces in said sill, and fillet welds in-between said weld surfaces and said side walls.

13. The apparatus according to claim 10 or 11 wherein said means forming high-shear strength weld attachments have a shear strength area to withstand at least 65% to 85% of the load imposed on said front draft lugs.

14. The apparatus according to claim 10 wherein the side walls of said striker include outwardly-projecting rib sections from aligned horizontal key slots in said side walls, said apparatus further including means for forming weld attachments between said rib sections and said sill, and wherein said means for forming high-shear strength weld attachments are symmetrically situated above and below said key slots on each of said side walls, and means forming substantially lower shear strength weld attachments are symmetrically situated above and below said key slots on each of said side walls.

* * * * *